US007837916B2

(12) United States Patent
Paren et al.

(10) Patent No.: US 7,837,916 B2
(45) Date of Patent: Nov. 23, 2010

(54) METHOD FOR MANUFACTURING SILICATE-CONTAINING FIBER

(75) Inventors: Aarto Paren, Kuusankoski (FI); Timo Partanen, Valkeakoski (FI); Asko Peltonen, Valkeakoski (FI)

(73) Assignee: Sateri International Co. Ltd., Road Town, Tortola (VG)

( * ) Notice: Subject to any disclaimer, the term of this patent is extended or adjusted under 35 U.S.C. 154(b) by 431 days.

(21) Appl. No.: 11/628,466

(22) PCT Filed: Jun. 1, 2005

(86) PCT No.: PCT/FI2005/050187

§ 371 (c)(1),
(2), (4) Date: Aug. 14, 2007

(87) PCT Pub. No.: WO2005/118922

PCT Pub. Date: Dec. 15, 2005

(65) Prior Publication Data

US 2008/0093767 A1 Apr. 24, 2008

(30) Foreign Application Priority Data

Jun. 2, 2004 (FI) ..... 20045204

(51) Int. Cl.

| | |
|---|---|
| ***D01F 2/06*** | (2006.01) |
| ***C08B 16/00*** | (2006.01) |
| ***C08B 9/00*** | (2006.01) |
| ***C08L 1/24*** | (2006.01) |

(52) U.S. Cl. ..... 264/188; 536/57; 536/60; 536/61; 106/166.1; 106/166.01

(58) Field of Classification Search ..... 264/188; 536/57, 60, 61; 106/166.01, 166.1, 166.82
See application file for complete search history.

(56) References Cited

U.S. PATENT DOCUMENTS

| | | | | |
|---|---|---|---|---|
| 2,086,309 | A | 7/1937 | Wharton | |
| 2,109,591 | A * | 3/1938 | Lilienfeld | 427/339 |
| 5,417,752 | A * | 5/1995 | Paren et al. | 106/166.82 |

FOREIGN PATENT DOCUMENTS

| | | |
|---|---|---|
| DE | 3536650 | 4/1987 |
| DE | 296 806 | 12/1991 |
| DE | 299 383 | 4/1992 |

(Continued)

OTHER PUBLICATIONS

PCT/ISA/210—Internal Search Report issued by Patent Office.

(Continued)

*Primary Examiner*—Khanh Nguyen
*Assistant Examiner*—Carson Gross
(74) *Attorney, Agent, or Firm*—Venable LLP; Eric J. Franklin

(57) ABSTRACT

A method for manufacturing silicate-containing fiber, wherein silicon dioxide is added to viscose manufactured of cellulose, and the formed mixture of viscose and silicon dioxide is directed via nozzles to a regeneration solution, to which silicate is added.

11 Claims, 1 Drawing Sheet

FOREIGN PATENT DOCUMENTS

| | | | |
|---|---|---|---|
| GB | 217068 | * | 6/1924 |
| GB | 217068 A | | 6/1924 |
| GB | 384440 A | | 12/1932 |
| GB | 1064271 | | 4/1963 |
| GB | 1064271 | * | 4/1967 |
| JP | 5247727 (A) | | 9/1993 |
| JP | 8120541 (A) | | 5/1996 |
| SU | 1386679 A1 | | 1/1988 |
| SU | 1620512 A1 | | 1/1991 |

OTHER PUBLICATIONS

Search Report issued by Finnish Patent Office.

Decision on Grant Patent for Invention, issued by the Russian Patent Office (along with an English translation) in counterpart Russian Application No. 2006147252.

* cited by examiner

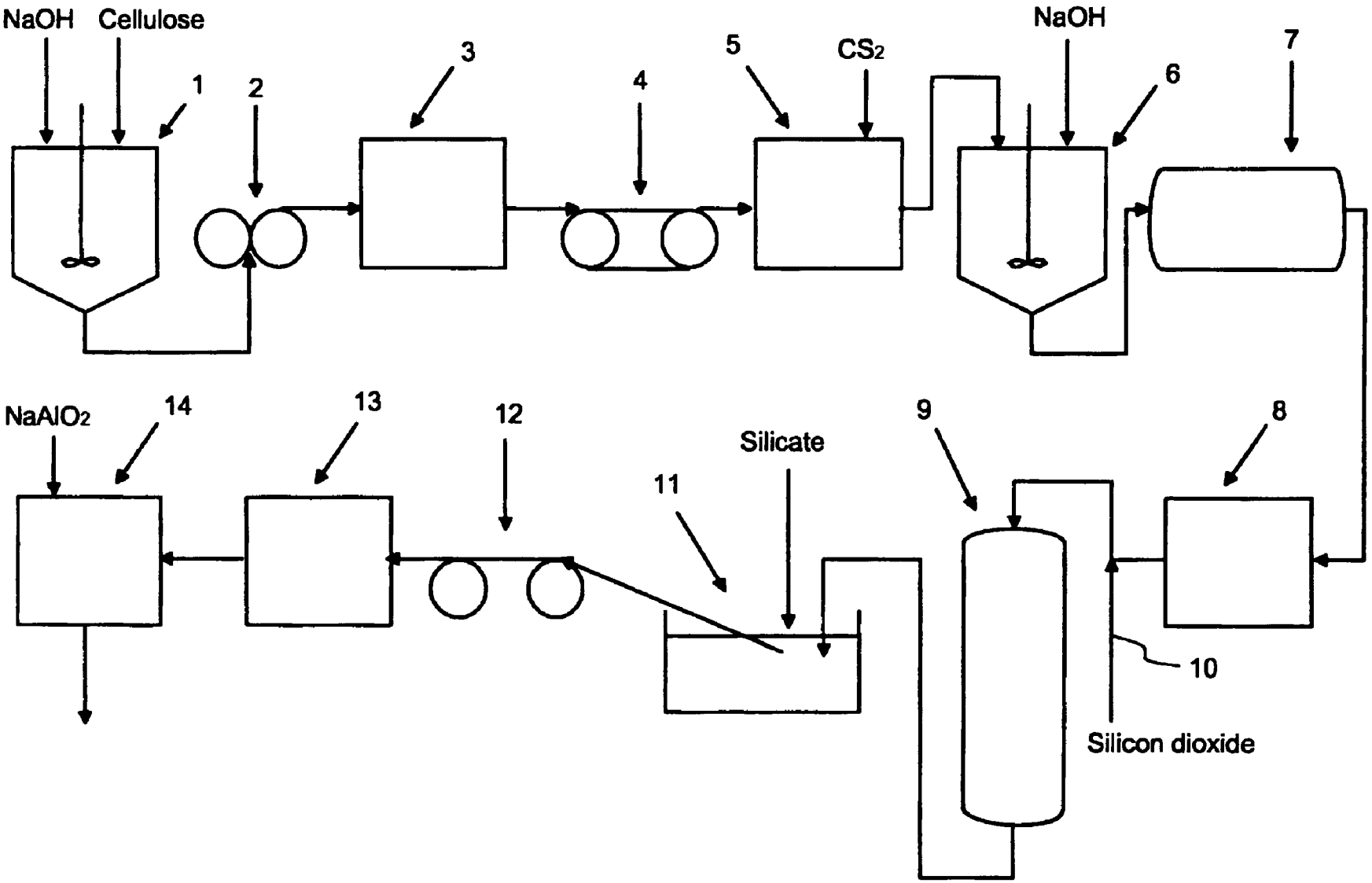
NaOH
Cellulose
1
2
3
4
5
$CS_2$
NaOH
6
7
8
9
10
Silicon dioxide
Silicate
11
12
13
14
$NaAlO_2$

METHOD FOR MANUFACTURING SILICATE-CONTAINING FIBER

CROSS-REFERENCE TO RELATED APPLICATIONS

This application claims priority to Finnish patent application 20045204 filed 2 Jun. 2004 and is the national phase under 35 U.S.C. §371 of PCT/FI2005/050187 filed 1 Jun. 2005.

FIELD OF THE INVENTION

The invention relates to a method for manufacturing silicate-containing fiber.

BACKGROUND OF THE INVENTION

Materials that are not easily burned or are non-combustible are increasingly used in the production of furniture and textiles. For example, in upholstery materials, such as fabrics, fibers that do not catch fire easily, or are non-flammable, and prevent fire are used. This kind of fibers include, inter alia, silicate-containing fibers.

One manner to manufacture silicate-containing fibers is to adapt viscose manufactured of cellulose by adding silicon dioxide to it and by spinning and processing the thus created silicate-containing fiber for further use. This kind of a method is presented, for example, in the GB patent 1064271, where the viscose-containing sodium silicate is spun into an acidic spinning solution, where the regeneration of the viscose into cellulose takes place, and at the same time, the sodium silicate in the viscose precipitates into silicon acid, which is water-containing silicon dioxide evenly distributed throughout the cellulose.

The method according to the above-mentioned patent is an inexpensive manner to manufacture silicate-containing fibers. The problem is that the silicon acid in the fibers formed by this method does not endure the alkaline detergents used in washing of textiles. In repeated washes, the silicon acid contained by the fibers dissolves into the alkaline washing liquid, which leads into a decreased fire durability.

The above-mentioned problem is solved in the FI patent 91778 (corresponds to U.S. Pat. No. 5,417,752) by processing the spun silicate-containing viscose fiber with sodium aluminate, wherein the silicon dioxide that is in silicon acid form in the silicate reacts with the aluminate and forms aluminum silicate groups in the silicon acid. The solubility of the aluminum silicate groups-containing silicon acid to alkaline detergents is very small, and therefore the product can be washed with normal detergents without its fire prevention properties being altered. In addition, the product containing aluminum silicate groups has a significantly better fire protection efficiency than products manufactured without aluminate.

The problem with the methods according to both of the above-mentioned publications is, however, the tendency of the silicate contained by the viscose, i.e. the silicon acid or silica ($SiO_2.nH_2O$) to dissolve into the spinning solution in spinning. It has been detected that a significant part of the silicate, even hundreds of milligrams/liter of spinning solution, may remain in the spinning solution in spinning. The uncontrolled dissolution of silicate and dispersion into the spinning solution causes several problems. The silicate forms precipitate in the spinning bath, which causes fouling of the spinning bath and increases friction between the tow consisting of thousands of fibers that is formed in the spinning bath and, and the stretch rolls, i.e. galets and stretch stones. Friction between individual fibers also increases in the tow, which weakens the stretchability of the tow and thus also the strength of an individual fiber. The friction between fibers also causes fibers to fray at the spinner.

The uncontrolled dissolution of silicate from the fibers into the spinning solution also causes quality fluctuations in them. This can be seen as fluctuations in the strength values and titer, i.e. the weight/length values of the fiber, which deteriorates the textile properties of the fiber. In addition, a decrease in the amount of silicate in a fiber leads to a weakened fire durability of the finished fiber, because even only a decrease of 1 to 2% in the amount of silicate deteriorates fire protection significantly.

BRIEF DESCRIPTION OF THE INVENTION

Therefore, the purpose of the present invention is to provide an improved method for manufacturing silicate-containing fiber, which avoids the above-mentioned problems and where the fiber manufactured according to the method has as high as possible silicate concentration.

The invention is based on the idea that the composition of the regeneration solution used in manufacturing silicate-containing fiber, i.e. the spinning solution used as spinning bath is formed into such that the silicate concentration of the fiber being manufactured can be kept as high as possible. This can be implemented by means of the method according to the invention, which utilizes the surprising observation that by adding a suitable amount of soluble silicate in a controlled manner into the spinning solution, the solubility of the silicate in the fibers to the spinning solution decreases. Thus, the amount of silicate contained by the viscose fiber can be kept as high as possible.

In the silicate-containing fibers formed in the spinning bath the silicate is evenly distributed in the fiber. The silicate on the outer surface of the fibers, however, comes into contact with the spinning solution during the spinning of fibers and dissolves into the spinning solution and crystallizes into it. This crystallization is completely uncontrolled and causes the above-described problems. By adding soluble silicate according to the invention to the spinning solution, the uncontrolled dissolution and crystallization of the silicate on the surface of the fibers can be prevented.

The silicate added to the spinning bath can be water-soluble alkali metal silicate, such as sodium silicate, for example, water glass ($Na_2O.nSiO_2$) or water-soluble precipitated silicate. The silicate concentration of the spinning bath can vary between 50 and 1,000 mg/l of spinning solution, advantageously it is between 100 and 700 mg/l of spinning solution. The silicate is added directly to the spinning bath, among the other chemicals forming the spinning solution. The spinning solution is continuously recirculated between the processes of the spinning bath and the spinning solution during spinning.

According to an advantageous embodiment of the invention, the spinning solution is kept saturated or nearly saturated by the soluble silicate by removing or adding silicate in a controlled manner to the spinning bath. The extra silicate precipitated in the spinning bath can be removed by means of any filtering method known as such, for example, by sand filtration, pressure filtration or a curved screen.

According to a second embodiment of the invention, in the manufacturing process of silicate-containing fiber, silicate-containing solutions are used also in the stretching and washing stages of the fiber, which follow the spinning stage.

Further, according to a third embodiment of the invention, the silicate concentration of the silicate-containing fiber can be controlled onto a desired level by controlling the amount of silicate added to the spinning solution.

By means of the method, the uncontrolled dissolution of silicate from the silicate-containing fiber into the spinning solution can be eliminated and the problems caused by the friction between the fibers caused by the silicate powder precipitating in the spinning bath can be removed. As a result of that, the fluctuations in the quality properties of the fibers also decrease. The deviations of the strength and titer values measured of the fibers are smaller than that of the fibers manufactured by means of the methods according to prior art, which improves their textile properties. In addition, the increase in the amount of silicate contained by the fibers improves the fire protection properties of the fibers significantly.

By means of the method it is also possible to produce viscose fibers whose silicate concentration has been controlled onto a specific level according to the desires of the customer.

Application of the method is easy and simple and it is easy to apply to the already existing plants manufacturing silicate-containing fiber.

BRIEF DESCRIPTION OF THE DRAWINGS

In the following, the invention is described more in detail with reference to the appended FIGURE, which schematically shows the method for manufacturing silicate-containing fiber according to the invention.

DETAILED DESCRIPTION OF THE INVENTION

The FIGURE shows a manufacturing method for viscose fiber, wherein in stage 1, the dissolving cellulose processed by means of sodium hydroxide (NaOH) is sludged into slush pulp. After this, the cellulose is pressed in stage 2 for removing the sodium hydroxide from it, and the resulting alkali cellulose is shredded in stage 3. The shredded alkali cellulose is directed to stage 4, i.e. prematuring, where it stays under the effect of the oxygen in air for about 3 to 5 hours in a temperature of approximately 35 to 45° C. In prematuring, the alkali cellulose is partly depolymerized.

Next, the prematured alkali cellulose is directed to sulphurization (stage 5), where carbon bisulphide ($CS_2$) is mixed into the alkali cellulose, in which case cellulose xanthate is formed. After the sulphurization, weak sodium hydroxide (NaOH) is added in stage 6 to the xanthate while mixing at the same time, which leads to dissolution of xanthate, which is almost complete after 1 hour of dissolution. The orange-yellow, syrupy viscose received from stage 6 is directed through the ageing tanks of stage 7.

During the ageing and after that in stage 8, the viscose is filtered. The next process stage 9 is deaeration. Before deaeration, for example at the point marked with the arrow 10, silicon dioxide solution is added to the viscose resulting in a mixed viscose formed by viscose and silicon dioxide. If desired, the silicon dioxide can also be added in an earlier process stage, i.e. in any suitable process stage/point before the spinning bath. The silicon dioxide added to the viscose can be, for example, commercial silicon dioxide, such as water glass ($Na_2O.nSiO_2$) or a mixture of silicon dioxide and sodium hydroxide. In the deaeration stage 9 the air and gas bubbles are removed from the viscose/silicon dioxide-mixture viscose.

Next, the mixed viscose is directed to the spinning stage 11, where the formation of viscose fibers takes place. The mixed viscose is directed to the spinning bath, below the surface of the spinning solution, through the small-perforation nozzles, spinnerettes of the spinning candle. There are generally about 8,000 to 50,000 holes in the spinnerettes, whose diameter is between 50 and 80 μm. The spinning solution is acidic liquor, which typically contains sulphuric acid ($H_2SO_4$), zinc sulphate ($ZnSO_4$) and sodium sulphate ($Na_2SO_4$). The sodium sulphate is formed in the solution when the sulphuric acid contained by the solution and the sodium hydroxide in the mixed viscose react. The temperature of the spinning solution is approximately 0 to 100° C., typically approximately 40 to 70° C. According to the invention, soluble silicate, for example, sodium silicate, is also added to the spinning solution, which results in that the silicate in the viscose/silicon dioxide-fiber forming in the spinning bath does not dissolve into the spinning bath, but remains in the fiber. The ratio of the components contained by the spinning solution may vary in the following way:

| | |
|---|---|
| sulphuric acid | 40 to 150 g/l of spinning solution |
| sodium sulphate | 20 to 40 wt-% |
| zinc sulphate | 0 to 100 g/l of spinning solution |
| sodium silicate | 50 to 1,000 mg/l of spinning solution, advantageously 100 to 700 mg/l, calculated as $SiO_2$ |

The composition of the spinning bath varies depending on the quality targets and properties of the fiber being manufactured, for example its thickness.

Silicate is added in a controlled manner into the spinning bath, i.e. in the manner that the silicate concentration of the fiber being spun remains as high as possible, but the properties of the spinning solution and the silicate precipitating in it do not cause problems in spinning and in the operation of the spinning apparatus. Thus, silicate can be added to the bath in suitable portions continuously or at set intervals. The silicate precipitated in the spinning bath is removed in a controlled manner as well, depending on the amount of the precipitated silicate.

The solid cellulose-filament fibers forming in the spinning bath are collected from the bath in such a manner that the tow formed by the thousands of fibers coming from one spinnerette is in stage 12 wound around smaller stretch rolls first, and then further via a stretch bath to other, bigger stretch rolls, i.e. stretch stones. The stretch not only lengthens the fibers 50 to 100%, but also increases their strength. After the stretch the tow formed of the fibers is directed to the cutting stage 13 where it is cut into a desired length. The cut fibers are rinsed with water to the washing stage 14. Thus, the fiber bundles break up and the washing of individual fibers can be continued in stage 14.

In the drawing and washing stages it is possible to also use silicate-containing solutions, which assists in keeping the silicate concentration in the fibers as high as possible.

In the washing stage 14 it is also possible, if desired, to treat the fibers with some aluminum containing solution, such as, for example, sodium aluminate solution ($NaAlO_2$). As a result of this, the silicon acid contained by the fibers is modified into aluminum silicate, which results in a fiber that endures washing and even bleaching chemicals well, which, however, feels the same as a normal viscose fiber.

After the possible sodium aluminate processing, the fibers are processed further in stage 14 in a normal manner, i.e. they are washed, the pH is adjusted and they are processed with surface-active agents. After this the fibers are dried.

According to an advantageous embodiment, the amount of silicate added to the spinning bath is such that the bath is saturated in relation to dissoluble silicate, or almost saturated. The extra silicate precipitated in the spinning bath is removed in connection with the circulation of the spinning solution.

The devices use in the above-described manufacture of viscose fiber and their operation are known as such to a man skilled in the art, which is why they are not described more in detail here.

In the following, some test results of the method according to the invention for manufacturing silicate-containing fiber will be presented. In the test, the silicate concentration of the spinning solution was varied and at the same time the silicate concentration of the viscose fibers resulting from the spinning was monitored.

Test Arrangements:

The viscose was manufactured by means of the viscose method described above and known as such, wherein sodium silicate, i.e. water glass, was added to the viscose as silicon dioxide. Thus, the result was a mixed viscose containing 3.6% of $SiO_2$, 8.2% of alpha-cellulose, and 7.4% of NaOH. 3.5 dtex of fiber was spun of this mixed viscose. The temperature of the spinning solution was 50° C. and its composition without the silicate addition was as follows:

| | |
|---|---|
| sulphuric acid | 65 g/l of spinning solution |
| sodium sulphate | 20 wt-% |
| zinc sulphate | 45 g/l of spinning solution |

A certain amount of silicate was added into the spinning bath at set intervals in such a manner that the silicate concentration of the spinning solution increased gradually. Commercially available water glass ($SiO_2$:$Na_2O$ 2.5:1, 30.9% $SiO_2$) was used as the added silicate. After each addition, fibers were spun to the solution in the manner presented above. After the spinning bath the fiber was stretched 90% longer than original in the stretching bath, in which the temperature was 90° C. and which contained 3 g/l of sulphuric acid.

The silicon dioxide content of the spinning solution was determined by a spectraphotometer by using the so-called molybdenum sine method. Before the determination the spinning solution was circulated for about and hour in order for the acid balance to normalize.

The effect of the silicate additions on the silicate concentration of the viscose fibers resulting from the spinning was monitored by analyzing the $SiO_2$-content of the spun fibers after each silicate addition. The $SiO_2$-content of the fibers was determined by ashing the fiber in the furnace in 750° C. for an hour and by weighing the resulting ash. The silicon dioxide in the fibers was found to be almost pure $SiO_2$.

The following table presents the effect of the silicate concentration of the spinning bath on the $SiO_2$-concentration of the fiber:

TABLE 1

The amount of silicate added to the spinning bath, the measured silicate concentration of the bath, and the $SiO_2$-concentration of the fibers spun to the bath in question

| Test No. | Water glass g/l of spinning solution added to the spinning bath | $SiO_2$ in the spinning bath/ppm | $SiO_2$ in the fiber % |
|---|---|---|---|
| 1 | 0 | <20 (no addition) | 24.7 |
| 2 | 1.25 | 250 | 27.2 |
| 3 | 1.75 | 336 | 32.2 |
| 4 | 1.75 | 347 | 32.9 |
| 5 | 2.25 | 466 | 33.0 |
| 6 | 2.25 | 477 | 32.9 |
| 7 | 2.75 | 535 | 33.0 |

From the results of Table 1 it is detected that the addition of silicate to the spinning bath increases the silicate concentration of the fibers received as a result of spinning, i.e. the dissolution of the silicate in the fibers into the spinning bath is decreased. The saturation point of the solution in relation to silicate was reached in test 4. The larger silicate additions after that to the spinning bath did not have an effect on the silicate concentration of the fiber any more, but it remained constant.

In addition, when fibers are compared, of which one was spun to the spinning solution that was saturated with silicate (test 4) and the other to a solution to which was added very little or no silicate (tests 1 and 2), it is noticed that without the silicate addition, an approximately 8% weight loss took place in the fiber in the spinning, i.e. the dissolution of the silicate from the fibers into the spinning solution was significant. This has an effect on the fire protection properties of the fiber. In fact, the fibers produced in tests 1 and 2 are inadequate in their fire protection properties and the unanticipated weight loss impedes the control of the fiber dtex (weight/length). By keeping the silicate concentration of the spinning bath on a suitable level, these problems can be removed.

A part of the fibers manufactured in the above-presented tests (tests 1 to 7) were also processed with aluminate. Processing with sodium aluminate solution (3 g/l of Na aluminate calculated as $Al_2O_3$, solution ratio 1:10, temperature 50° C.) increased the ash content of the fiber 2 to 2.5% of the values presented in Table 1. Thus, the ash also contained aluminum.

The invention is not intended to be limited to the above embodiments presented as an example, but the invention is intended to be applied widely within the scope of the inventive idea as defined in the appended claims.

The invention claimed is:

1. A method for manufacturing silicate-containing fiber, the method comprising:

adding silicon dioxide to viscose manufactured of cellulose;

directing the viscose and silicon dioxide via nozzles to an acidic regeneration solution, where silicate-containing fibers having a silicate concentration are formed; and decreasing a solubility of the silicate in the fibers to the regeneration solution by adding soluble silicate to the regeneration solution.

2. The method according to claim 1, wherein the silicate added to the regeneration solution is dissoluble alkali metal silicate or water-soluble precipitated silicate.

3. The method according to claim 1, wherein 50 to 1,000 mg/l of silicate, calculated as $SiO_2$, is added to the regeneration solution.

4. The method according to claim 1, wherein 100 to 700 mg/l of silicate, calculated as $SiO_2$, is added to the regeneration solution.

5. The method according to claim 1, wherein the amount of silicate added to the regeneration solution is such that the regeneration solution is saturated by the soluble silicate.

6. The method according to claim 5, further comprising:

removing the silicate precipitated into the regeneration solution from the regeneration solution in connection with its circulation.

7. The method according to claim 1, wherein silicate is added to the regeneration solution directly to the spinning stage before the mixture of viscose and silicon dioxide is directed to the regeneration solution.

8. The method according to claim 1, wherein the regeneration solution also contains sulfuric acid, sodium sulfate and zinc sulfate.

9. The method according to claim 1, wherein silicate is added to and removed from the regeneration solution.

10. The method according to claim 9, wherein adding and removing silicate from the regeneration solution is performed in a controlled manner in such a way that the silicate concentration of the regeneration solution remains on a suitable level.

11. The method according to claim 1, wherein the silicate concentration of the silicate-containing fiber is controlled onto a desired level by controlling the amount of silicate added to the regeneration solution.

* * * * *